United States Patent [19]

Godwin

[11] 4,239,136

[45] Dec. 16, 1980

[54] KEY BAND

[76] Inventor: Edward J. Godwin, 9609 Grandville, Detroit, Mich. 48228

[21] Appl. No.: 36,784

[22] Filed: May 7, 1979

[51] Int. Cl.[3] ..... A45C 11/42

[52] U.S. Cl. ..... 224/219; 70/458; 150/40; 224/267

[58] Field of Search ..... 224/219, 221, 222, 267; 206/38; 150/37; 24/3 R, 3 A, 3 F; 70/456 R, 457, 458, 429, 430; 63/3

[56] References Cited

U.S. PATENT DOCUMENTS

| | | | |
|---|---|---|---|
| 1,325,607 | 12/1919 | Barber | 224/219 |
| 1,600,633 | 9/1926 | Hildebrand | 150/37 UX |
| 3,063,487 | 11/1962 | Mullin | 150/37 |
| 3,160,168 | 12/1964 | Conley | 150/37 |
| 3,522,829 | 8/1970 | Weintraub | 150/40 |

FOREIGN PATENT DOCUMENTS

| | | | |
|---|---|---|---|
| 2049167 | 4/1972 | Fed. Rep. of Germany | 224/219 |
| 509163 | 8/1920 | France | 224/219 |
| 129440 | 1/1929 | Switzerland | 224/219 |

*Primary Examiner*—Robert J. Spar
*Assistant Examiner*—Jerold M. Forsberg
*Attorney, Agent, or Firm*—Whittemore, Hulbert & Belknap

[57] ABSTRACT

A key band including a flexible holder for retaining a key therein having a slot adjacent one end thereof by means of which a key may be placed into and withdrawn from the holder, and a wrist band to which the key holder is secured.

5 Claims, 9 Drawing Figures

FIG. 1
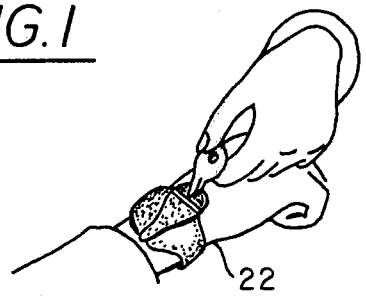
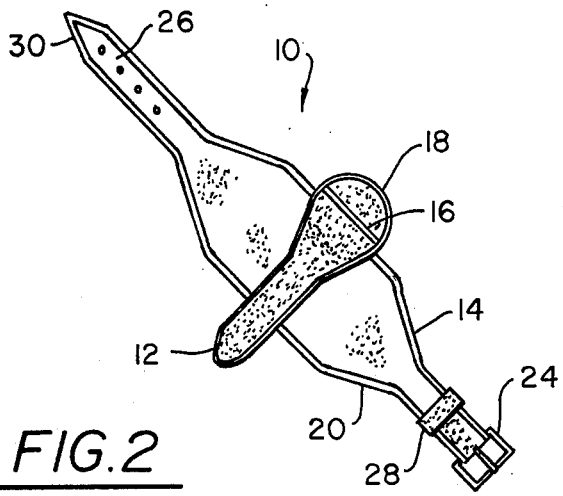
FIG. 2
FIG. 3
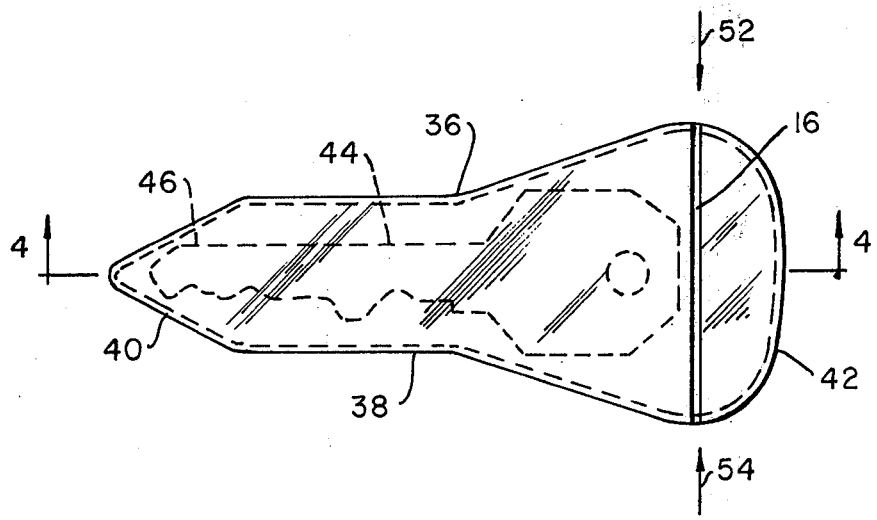
FIG. 4
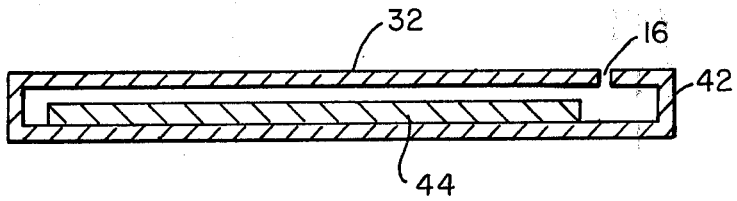

KEY BAND

BACKGROUND OF THE INVENTION

1. Field of the Invention

The invention relates to key carrying structure and refers more specifically to a flexible key holder for completely encompassing a key secured to a wrist band whereby the key may be safely and conveniently transported.

2. Description of the Prior Art

In the past, single keys have often been carried loose in pockets, purses, and the like. Such transportation of keys often results in their loss or at least in the keys being misplaced so that time is wasted in finding the key when it is desired to use the key. Further, in many instances wherein casual clothing is used, such as for bicycling, boating and the like, there is no convenient place for a person to carry a key such as a house key or the like.

Past key holders have usually been key chains or the like which are utilized to secure a plurality of keys together. Such key chains do not, however, serve to provide a convenient means for transporting the keys secured together. Further, it is often desired to carry only one or two keys as, for example, in the case of school age children who must carry house keys, athletes engaged in a sport, and the like.

SUMMARY OF THE INVENTION

In accordance with the invention, there is provided a key band including a flexible key holder for completely encompassing a key having a slot in one end thereof through which the key may be inserted into or withdrawn from the holder and a wrist band to which the key holder is secured whereby one or two keys may be conveniently transported attached to the user's wrist so that the key is always safe from loss and convenient for use.

BRIEF DESCRIPTION OF THE DRAWINGS

FIG. 1 is a perspective view of a key band constructed in accordance with the invention in use.

FIG. 2 is an enlarged top view of the extended key band illustrated in FIG. 1.

FIG. 3 is an enlarged top view of the key holder portion of the key band illustrated in FIGS. 1 and 2.

FIG. 4 is a longitudinal section view of the key holder illustrated in FIG. 3, taken substantially on the line 4—4 in FIG. 3.

DESCRIPTION OF THE PREFERRED EMBODIMENTS

Figure 5:
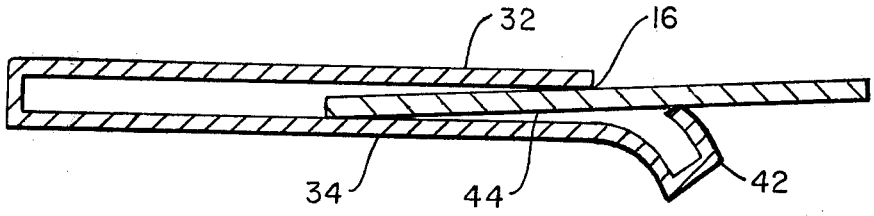
FIG. 5 is another longitudinal section view of the key holder illustrated in FIG. 3, taken substantially on the line 4—4 and showing one end of the key holder bent to permit removal of a key from the holder.

The key band 10 of the invention, as shown best in FIG. 2, includes a key holder 12 and a wrist band 14.

A slot 16 is provided in the key holder 12 adjacent one end 18 thereof through which a key may be inserted in the key holder 12 or removed therefrom, as desired.

More specifically, the wrist band 14 includes a flexible strap 20 adapted to be wrapped around the wrist 22 of someone who wishes to transport a key. The wrist band 14 further includes a buckle 24 and the cooperating openings 26 at opposite ends of strap 20 for securing the wrist band 14 to a user's wrist 22. As shown, the wrist band 14 further includes the loop 28 for securing the end 30 of strap 20 after it has passed through the buckle 24.

The key holder 12 is a somewhat flexible compartment for completely enclosing at least one key therein. In the embodiment shown in FIG. 3, the key holder includes the top 32, bottom 34, sides 36 and 38 and ends 40 and 42.

The slot 16 extends across the top 32 of the key holder 12 adjacent the end 42 thereof. Slot 16 is provided for positioning a key within the key holder 12 and for removing a key therefrom as desired.

The key holder 12 is slightly larger between the slot 16 and the end 40 than a key 44 which it is desired to transport in the key band 10.

Both the wrist band 14 and the key holder 12 may be constructed of flexible material such as leather or vinyl or acrylic resinous material.

In use, a key may be inserted in the key holder 12 through the slot 16 by first inserting the end 46 of the key in the slot 16 and deforming the flexible cover 32 of the key holder 12 to permit entry of the key 44 into the key holder 12. Once the key 44 is positioned in the key holder 12, the key holder 12 will tend to return to its original shape to hold the key 44 securely within the key holder 12.

After transporting the key when it is desired to remove the key from the key band 10 for use, the end 42 of the key holder 12 may be deformed and may actually be bent as shown in FIG. 5 to permit the key 44 to slide out of the key holder 12 through the slot 16.

Figure 6:
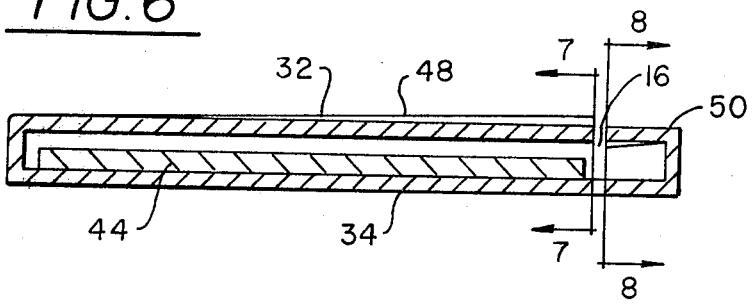
FIG. 6 is a longitudinal section view of a modified key holder such as shown in FIG. 3.
Figure 7:
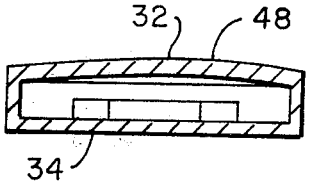
FIGS. 7 and 8 are transverse section views of the modified key holder illustrated in FIG. 6, taken on the lines 7—7 and 8—8 in FIG. 6, but shown in full cross-section.
Figure 8:
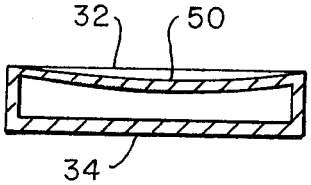

If desired, as shown best in FIG. 6, the key holder 12 may have an upper surface 32 which is slightly concave upwardly away from the wrist band 14 on one side 48 of the slot 16. The top 32 of the key case 10 may also be slightly concave down toward the wrist band, also as shown in FIG. 6, at the other side 50 of the slot 16. Such convex and concave surfaces further illustrated in FIGS. 7 and 8 permit opening of the slot 16 by slight pressure on the sides of the key holder 12 in the direction of arrows 52 and 54 shown in FIG. 3. Such construction assists in placing a key 44 in the key holder 12 and removal of the key therefrom.

Figure 9:
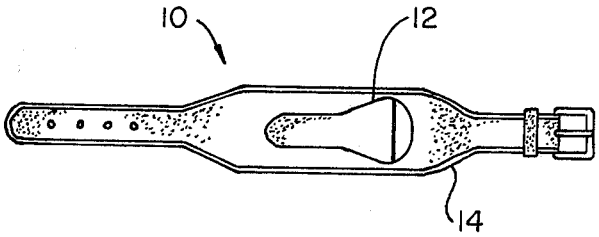
FIG. 9 is a plan view of a modified key band similar to that illustrated in FIGS. 1–5.

In the modification of the key band 10 of the invention illustrated in FIG. 9, the key holder 12 is positioned longitudinally of the wrist band 14.

Such construction may be more desirable for some users who have, for example, a wide wrist. The modification of the invention illustrated in FIG. 2 is more desirable for a smaller person such as a school child who would have a narrower wrist.

The wrist band 14 and key holder 12 in any modification thereof may be secured together by convenient means such as riveting, glueing, heat sealing, sewing, and the like.

While one embodiment and two modifications of the present invention have been considered in detail, it will be understood that other embodiments and modifications of the invention are contemplated by the inventor.

Thus, a plurality of separate wrist bands may be utilized with a single key holder, or the wrist band may be a rigid C-shaped metal band. Both the wrist band and key holder may be tooled, decorated, painted, and the like, as desired. It is therefore the intention to include all the embodiments and modifications thereof as are defined by the appended claims within the scope of the invention.

What is claimed is:

1. A key band comprising a flexible key holder compartment for completely containing a key positioned therein including top and bottom portions separated by sides and ends, said top portion having a slot positioned at one end thereof through which a key may be inserted in and removed from the compartment, which key holder compartment has a length from the slot to the other end thereof slightly larger than the length of a key to be contained therein and said top portion of said key holder compartment having a portion converted upwardly on the side of the slot away from the one end thereof and a portion concaved downwardly on the side of the slot adjacent the one end thereof, the total displacement of the convexed and concaved portions of the top portion at the slot being such that the slot is normally closed to prevent a key from sliding therefrom longitudinally, and an elongated wrist band to which the key holder compartment is secured for securing the key holder compartment to a person's wrist.

2. Structure as set forth in claim 1, wherein the key holder compartment is constructed of one of leather, vinyl and acrylic.

3. Structure as set forth in claim 1, wherein the key holder compartment extends transversely of the wrist band.

4. Structure as set forth in claim 1, wherein the key holder compartment extends longitudinally of the wrist band.

5. Structure as set forth in claim 1, wherein the wrist band is a flexible strap having a buckle attached to one end thereof and longitudinally spaced apart openings in the other end thereof.

* * * * *